United States Patent [19]

Wood et al.

[11] 4,233,920

[45] Nov. 18, 1980

[54] VEE HULL CONSTRUCTION

[75] Inventors: Forrest L. Wood, Flippin; Dale H. Jensen, Everton; Kenneth P. Poley, Yellville; Charles C. Hoover, Bull Shoals; Gary L. Wilson, Flippin, all of Ark.

[73] Assignee: Wood Manufacturing Company, Flippin, Ark.

[21] Appl. No.: 42,200

[22] Filed: May 24, 1979

[51] Int. Cl.[3] ..... B63B 1/00

[52] U.S. Cl. ..... 114/56; 114/291; 114/290

[58] Field of Search ..... 114/65 R, 61, 56, 62, 114/271, 289, 290, 291; 9/6 R, 6 P

[56] References Cited

U.S. PATENT DOCUMENTS

| | | | |
|---|---|---|---|
| 3,051,115 | 8/1962 | Canazzi | 114/288 |
| 3,259,092 | 7/1966 | Kara | 114/56 |
| 3,698,342 | 10/1972 | Jackson | 114/288 |
| 4,027,613 | 6/1977 | Wollard | 114/291 |

*Primary Examiner*—Charles E. Frankfort
*Assistant Examiner*—D. W. Keen
*Attorney, Agent, or Firm*—Colton & Stone, Inc.

[57] ABSTRACT

The performance characteristics of a vee type planing hull are significantly increased by a combination of features for reducing drag and increasing attitude control.

Exemplary of the former are a concave running pad to which air is inducted to reduce hull drag and an angled transom terminating at a transverse hull "step" which permits the outboard propulsion unit to be carried higher reducing unit drag. The presence of longitudinal "wedges" increase hull lift as planing speed is approached allowing the hull to plane at a lower speed.

Transverse wedge elements positioned outboard of the concave running pad maintain a stern lifting torque for controlling bow up angle.

4 Claims, 5 Drawing Figures

FIG. 1
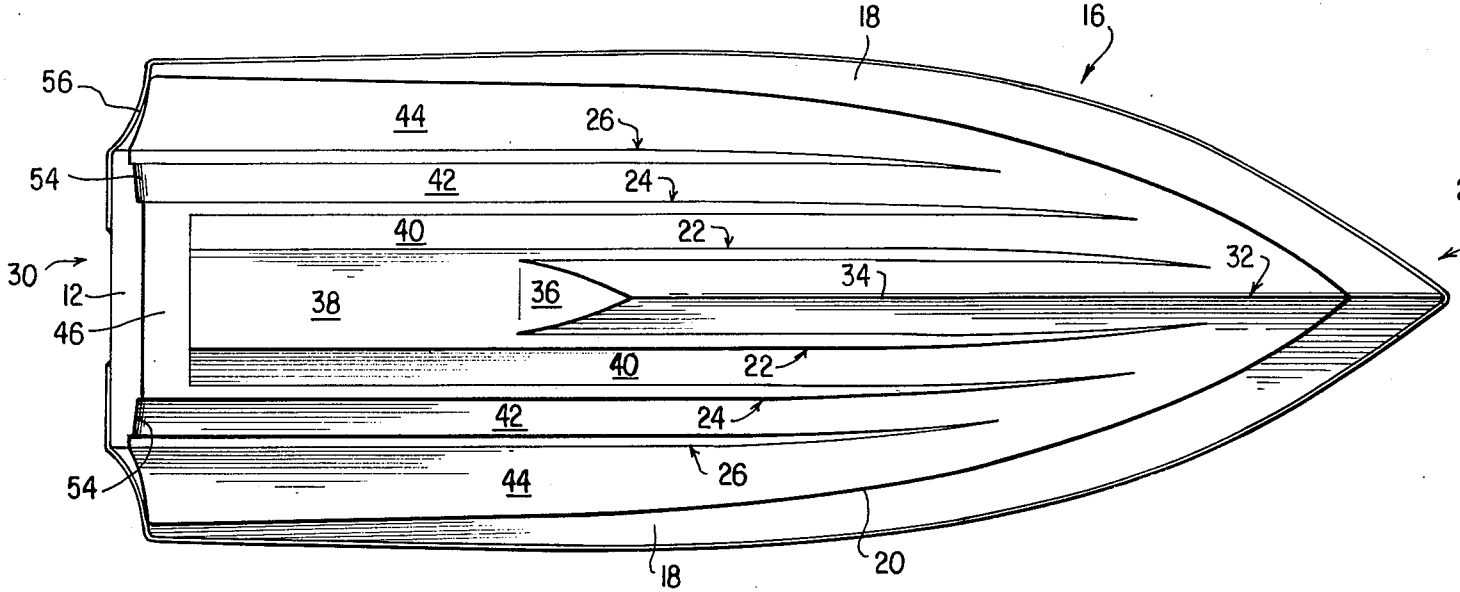
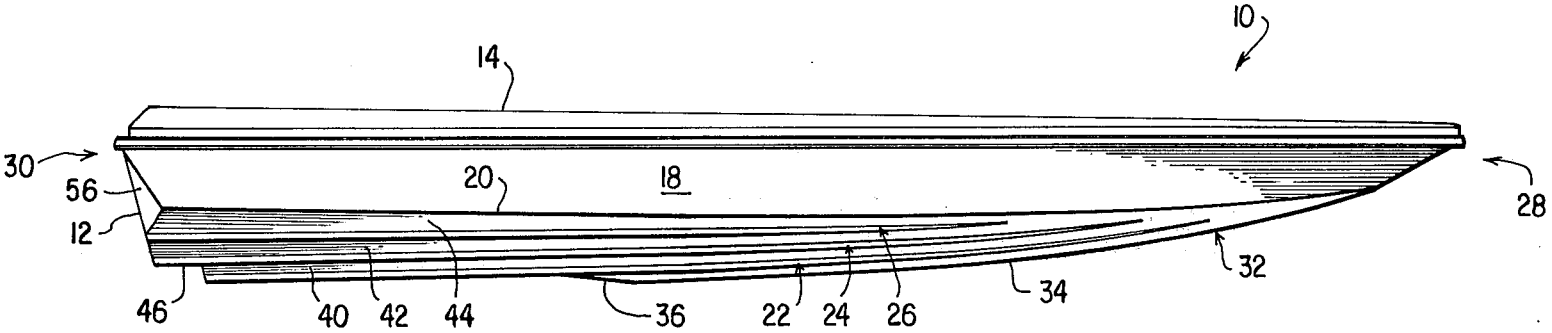
FIG. 2

VEE HULL CONSTRUCTION

BACKGROUND OF THE INVENTION

The invention relates to a modified vee hull design for power boats.

From the standpoint of eye appeal, alone, the vee hull is generally considered to be one of the most aesthetically pleasing hull designs for power boats and its marketplace popularity is such that inherent functional limitations, relative to other hull designs, tend to be tolerated or ignored.

Exemplary of such inherent limitations are:

1. The greater drag exerted at low speed across the relatively large vee hull area;
2. The tendency to produce a "bow up" attitude at low speed due to the requirement that the center of gravity be well aft of amidship for high speed planing;
3. The tendency of modified vee hulls employing a flat running pad to skid in high speed turns on plane;
4. The necessity for using a deeper drive unit, to avoid cavitation, with a concomitant increase in drive unit drag; and
5. The inherent drag, on plane, which is a function of the wet area on plane.

The enumerated low speed limitations may be ameliorated if the hull can be brought on plane at a significantly lesser speed than is conventional without producing an excessive bow up attitude which, itself, increases drag.

Similarly, if wet planing area can be reduced and tracking stability in high speed turns simultaneously increased, it is obvious that not only will power requirements be reduced but that overall top speed will be significantly increased.

The foregoing has been achieved in a production power boat as hereinafter described.

SUMMARY OF THE INVENTION

Although applicable to any planing power boat hull of the vee type, the following description relates to those powered by outboard propulsion units.

The heart of the invention is the utilization of a centerline keel portion, defined between a pair of central chines, which has a forward vee section transitioning via a planar, triangular area to an after concave running pad. The forward vee section performs its usual function when wet and, as speed increases and the bow comes up, the planar transition area comes into play to induct air to the concave running pad at a relatively low "bow up" angle to produce, in effect, a miniature tunnel type hull exhibiting the characteristic air current adjacent the hull and thus substantially reducing water drag. Because of the positionment of the transition area forward of the concave planing area, air is inducted and drag reduced at that critical point in time just before going on plane when increasing speed would normally dictate a dramatic increase in drag with concomitant increased power requirement to go on plane. Once on plane the concave running pad and its straddling chine pair provide significantly improved tracking stability in high speed turns. While the straddling chine pair exert their obvious influence, the force components acting against the concave side wall on the inside side of a high speed turn significantly reduce skidding that would otherwise occur. The relative stabilizing effect becomes more pronounced as the turn is steepened when the chine to the outside of the turn starts to come out of the water.

The efficacy of the centerline construction just described is further increased by the combination thereof, both individually and collectively, with the following hull improvements:

1. a downwardly and forwardly inclined rear transom continuous at the lower edge thereof with a transverse step positioned just aft of the concave running pad;
2. a plurality of outboard chine pairs terminating in longitudinally extending, downwardly directed wedges and defining therebetween and with outboard spray rails a plurality of longitudinally extending steps; and
3. transverse wedges symmetrically positioned outboard of the transverse step.

One purpose of the angled transom is to permit trim adjustments, while maintaining the necessary clearance between propeller and transom to avoid cavitation, between maximum forward for start-up and maximum rearward for planing to take place substantially within a positive rather than a negative quadrant considered from a vertical to the stern of the boat. The obvious advantage is that, with a transom mounted propulsion unit, greater stern raising torque can be exerted at low speed for quicker planing and high speeds on plane can be maintained at a given power setting because the drive resultant is essentially forward with a lesser downward component. The presence of the notched hull portion, or transverse step, just rearward of the concave pad allows the water flowing thereacross to assume an upward component as it leaves the pad and crosses the plane of the transom. Since the depth positionment of the drive propeller is dictated by the depth level at which water leaving the wetted portion of the hull will provide sufficient submergence to avoid cavitation; the transverse step permits propeller submergence at a higher level than would otherwise be possible thus allowing the propulsion unit to be carried higher with a substantial reduction in lower unit drag.

In addition to the foregoing, a major feature of the invention derives from the coaction of the angled transom and transverse step to effectively move the hull fulcral axis substantially forwardly of the propulsion unit mounting position thereby reducing that stern submergence characteristic of power start-up and initial acceleration under load.

Three longitudinal step pairs are defined by chine pairs and spray rails having longitudinally extending, downwardly directed wedges. The downwardly directed spray rail wedges perform their usual function while the chine wedges direct a significant proportion of that water that would otherwise flow transversely of the two innermost steps to assume a downward path thus exerting hull lift when the boat is underway and before coming on plane.

The innermost step pair terminate aft at the transverse step while the intermediate step pair straddle the transverse step and extend aft to the transom at which juncture the smooth flow characteristic therealong is blocked by downwardly directed transverse wedges. These transverse wedges are an important feature of the invention since they are primarily responsible for preventing excessive bow up attitude at lower speeds and particularly as planing speed is approached. It will be appreciated that the hull lift exerted by the transverse wedges is maximized by their placement for large net mass flow thereacross at all speeds just short of planing speed and at the extreme aft end of the hull for exerting maximum torque about the center of gravity of the boat. The stern lifting torque exerted by the transverse wedges also provide excellent porpoising control and improved control in slow speed turn. The transverse wedge to the inside of a high speed turn also reduces high speed roll as this wedge becomes wetted and exerts a counter-rolling lift.

The hull side walls are downwardly continuous with the spray rails and, at their aft ends, are continuous with concave, stepped stern portions merging the side walls and transom. The purpose of the stepped stern portions is to facilitate reverse maneuvering.

DESCRIPTION OF THE DRAWINGS

FIG. 1 is a bottom plan view of a power boat incorporating the novel hull of the present invention;

FIG. 2 is a side elevation of the power boat shown in FIG. 1;

DESCRIPTION OF THE PREFERRED EMBODIMENT

Figure 4:
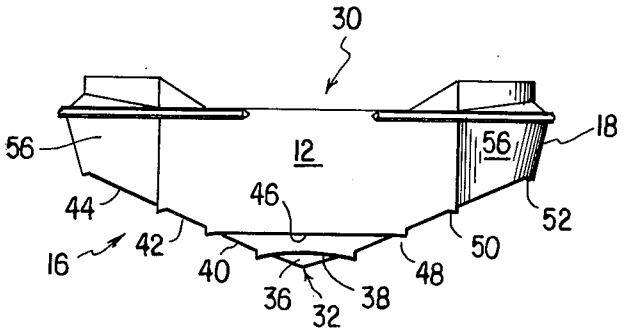
FIGS. 3 and 4 are front and rear elevations, respectively, of the power boat of FIGS. 1 and 2.
Figure 3:
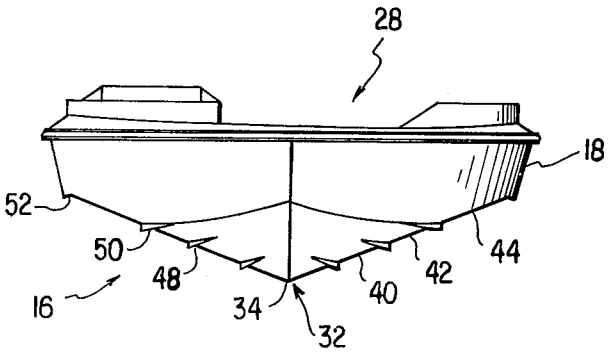
Figure 5:
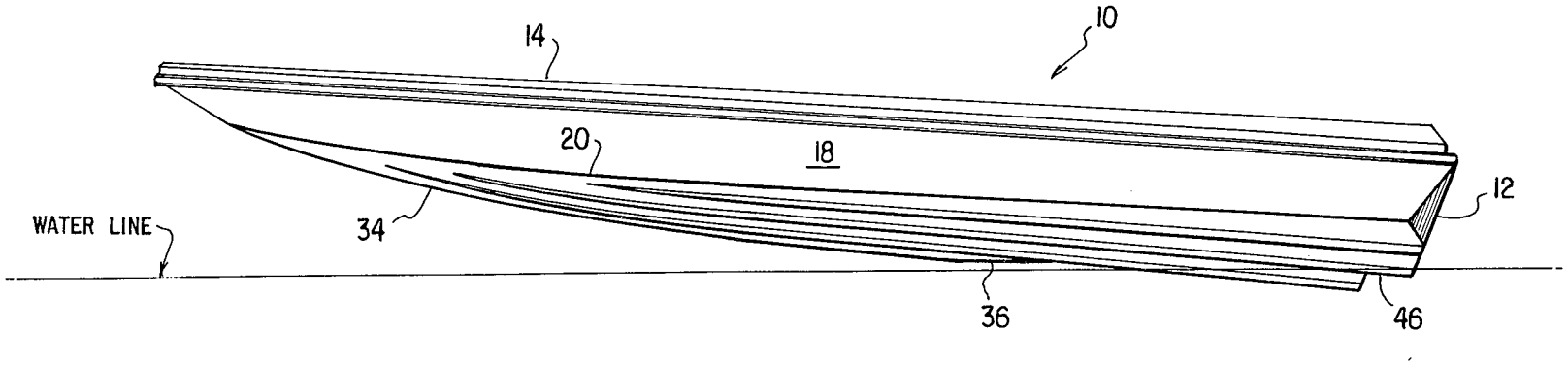
FIG. 5 is a side elevation of the boat as it appears on plane.

In FIGS. 1–5 is illustrated an open power boat 10, adapted to be driven by an outboard propulsion unit (not shown) mounted to transom 12, including a deck portion 14 surmounting the novel vee hull 16 which is the subject matter of the present invention.

Hull 16 includes side walls 18, downwardly continuous with spray rails 20, as well as central, intermediate and outboard chine pairs 22, 24, 26 extending fore and aft of the hull intermediate bow 28 and stern 30. Central chine pair 22 straddle centerline keel portion 32 which exhibits a forward vee portion 34 transitioning, via a planar triangular area 36, to an aft concave planing, or running, pad 38. Inboard, intermediate and outboard step pairs 40, 42, 44 are respectively defined, outboard of centerline keel portion 32, by the chine pairs and spray rails.

Transom 12 is angled inwardly and downwardly from the propulsion unit mounting position at the stern of the boat and terminates at its lowermost extent in a transverse step, or notch, 46 which defines the aft extent of concave pad 38 and inboard step pair 40.

It will be noted that the intermediate and outboard chine pairs 24, 26 include longitudinal, downwardly directed wedges 48, 50 quite similar in structure to the downwardly directed spray rail wedges 52 and serve a similar function of imparting a downward component to that water flow moving transversely thereacross to provide additional hull lift prior to the hull coming on plane. The intermediate wedges 48 display a slightly lesser downward wedge angle than do outer wedges 50 although this distinction is barely discernible as viewed from the stern in FIG. 4.

The intermediate step pair 42 terminate at the aft end thereof in downwardly directed, transverse wedges 54 which at all speeds prior to coming on plane exert a stern lifting torque which precludes excessive bow up angle and reduces porpoising. The dimensions of transverse wedges 54 are, of course, chosen to, in effect, "tune" the boat for the desired bow up angle underway as a function of boat dimensions and propulsion unit rating. The specific boat herein disclosed is depicted to scale of ½" : 1' and rated for 150 hp outboard unit. The transverse wedge 54 to the inside of a high speed turn exerts counter-rolling lift as explained above.

With an outboard propulsion unit conventionally mounted to transom 12 the presence of transverse step 46 allows water leaving the area of concave pad 38 to assume an upward flow component crossing the plane of transom 12 enroute to the propeller so that the same may be carried higher, with less drag, than in the absence of the transverse step. The downwardly and forwardly angled transom complements the effect of the transverse step, just described, by effectively moving the trough of the issuing wake forwardly so that the propeller will be submerged at or near the crest, on plane, in a near vertical or only slightly negative trim. In addition to the foregoing the angled transom and transverse step produce a significant advantage at start-up speeds in that the fulcral axis, adjacent the rear of the planing pad about which the boat is rotated upon start-up, is well forward in comparison to conventional boats thus reducing stern submergence.

As the boat approaches planing speed, triangular area 36 inducts air to concave pad 38 significantly reducing hull drag generally after the nature of a tunnel hull and such effect is maintained on plane as triangular area 36 directs air and water into the concave portion of pad 38.

In addition to reducing drag on plane, the concave pad substantially reduces skidding in high speed turns as previously explained.

The boat side walls 18 merge with transom 12 via concave, stepped stern portions 56 whose functional utility is that of increasing reverse maneuvering control.

What is claimed is:

1. In a power boat hull having a plurality of chine pairs extending fore and aft intermediate the bow and transom thereof; the central one of said chine pairs straddling a centerline keel portion exhibiting a forward vee section and an aft concave section comprising a concave planing pad; said forward vee section merging with said planing pad via an upwardly and rearwardly directed transition area for introducing air to said concave planing pad as the hull approaches full plane and directing air and water thereto during full plane; said concave planing pad terminating at the after end thereof in a transverse step immediately adjacent and forward of said transom whereby water flowing thereacross includes an upward component at the plane of the transom; and the plane of said transom extending, from above the water line, downwardly and forwardly to said transverse step.

2. In a power boat hull having at least three chine pairs extending fore and aft intermediate the bow and transom thereof; the central one of said chine pairs straddling a centerline keel portion exhibiting a forward vee section and an after concave section comprising a concave running pad; said forward vee section merging with said planing pad via an upwardly and rearwardly directed triangular transition area; said chine pairs including intermediate and outboard chine pairs delimiting, with said central chine pair and outboard spray rails, a plurality of step pairs; the inboard step pair, said central chine pair and said concave planing pad terminating at the after ends thereof in a transverse step forward of said transom defining a notched hull section; and an intermediate one of said step pairs terminating at said transom in downwardly directed, transverse wedges for imparting an upward stern thrust to said boat hull at speeds below planing speed.

3. The boat hull of claim 2 wherein said chine pairs are substantially parallel and at least two of said chine pairs include downwardly angled lower edges for directing water downwardly for increasing hull lift.

4. In a power boat hull having at least three chine pairs on the bottom thereof and an outboard spray rail merging the bottom and side walls of said hull; the central one of said chine pairs straddling a centerline keel portion having a forward vee section and an after concave section comprising a concave running pad; said forward vee section merging with said concave running pad via a planar, triangular transition area; said chine pairs and spray rail defining at least three step pairs outboard of said centerline keel portion; a downwardly and forwardly angled propulsion unit mounting transom at the stern of said hull; said hull including a transverse step marking the lower terminus of said transom and the aft termini of said concave pad and the inboard pair of said step pairs; an intermediate one of said step pairs extending outboard and aft of said transverse step to merge with said transom via downwardly directed transverse wedges at the merger of said intermediate one of said step pairs and transom for exerting stern lifting torque underway; the stern of said hull including symmetrical concave stern steps outboard of said transom and joining said transom with the aft ends of said side walls; and the aft ends of the outermost of said step pairs terminating at the lower edges of said concave stern steps.

* * * * *